US007669740B2

(12) United States Patent
Saunders et al.

(10) Patent No.: US 7,669,740 B2
(45) Date of Patent: Mar. 2, 2010

(54) BEVERAGE VENDING MACHINE INSTALLATION

(75) Inventors: Anthony Kevin Saunders, Oxon (GB); Neil Martin Rogers, Coventry (GB); Andrew Charles Bentley, Oxon (GB)

(73) Assignee: Kraft Foods R & D, Inc., Northfield, IL (US)

( * ) Notice: Subject to any disclaimer, the term of this patent is extended or adjusted under 35 U.S.C. 154(b) by 1445 days.

(21) Appl. No.: 10/969,153

(22) Filed: Oct. 20, 2004

(65) Prior Publication Data

US 2005/0115986 A1 Jun. 2, 2005

(30) Foreign Application Priority Data

Oct. 20, 2003 (GB) ..... 0324454.8

(51) Int. Cl.
*B67D 5/56* (2006.01)

(52) U.S. Cl. ..... 222/608; 222/129.1; 222/146.6; 312/249.9; 312/308; 312/350; 141/231; 296/22; 296/24.36; 700/243; D20/1; D20/4

(58) Field of Classification Search ..... 222/129, 222/129.1, 608–611.1, 143, 173, 182, 183, 222/146.6, 129.2–129.4; 141/231–233; 312/27, 249.8, 28, 249.9, 308, 350; D20/1, D20/4, 5, 8; 700/242, 243; 296/21, 22, 296.34, 296/24.36

See application file for complete search history.

(56) References Cited

U.S. PATENT DOCUMENTS

| | | | | | |
|---|---|---|---|---|---|
| 876,335 | A | * | 1/1908 | Couper et al. | 312/210.5 |
| 2,182,116 | A | * | 12/1939 | Copeman | 62/125 |
| 2,914,218 | A | * | 11/1959 | Korodi | 222/131 |
| 2,941,856 | A | * | 6/1960 | Frick | 312/277 |
| 3,837,300 | A | | 9/1974 | Karr | |
| 3,949,902 | A | * | 4/1976 | Thompson | 222/129.1 |
| 4,211,342 | A | | 7/1980 | Jamgochian et al. | |
| 4,911,332 | A | | 3/1990 | King | |
| 5,042,689 | A | * | 8/1991 | Mrugala et al. | 222/66 |
| 5,064,097 | A | * | 11/1991 | Brog et al. | 222/129 |
| 5,285,718 | A | | 2/1994 | Webster et al. | |
| 5,860,714 | A | | 1/1999 | Skord, Jr. | |
| 5,997,236 | A | | 12/1999 | Picioccio et al. | |
| 6,062,277 | A | * | 5/2000 | Seo | 141/362 |
| 6,116,460 | A | * | 9/2000 | Kim et al. | 221/96 |

(Continued)

FOREIGN PATENT DOCUMENTS

EP 0 596 634 B1 5/1996

(Continued)

*Primary Examiner*—J. Casimer Jacyna
(74) *Attorney, Agent, or Firm*—Fitch, Even, Tabin & Flannery

(57) ABSTRACT

A beverage vending machine installation comprising a cabinet and a trolley unit, the cabinet defining a void in which, in use, the trolley unit can be positioned. The cabinet has an opening and at least one door moveable between open and closed positions. A trolley unit comprises at least one beverage vending machine. The trolley unit is moveable relative to the cabinet between an installed position and an uninstalled position. In the installed position the trolley unit is positioned within the void of the cabinet such that at least one door may be closed to allow operation of the vending machine installation. In the uninstalled position, the trolley unit is removed from the cabinet after opening at least one door to allow access to the trolley unit.

12 Claims, 8 Drawing Sheets

U.S. PATENT DOCUMENTS

| | | | | |
|---|---|---|---|---|
| 6,135,009 | A * | 10/2000 | Lassota | 99/290 |
| 6,453,955 | B1 * | 9/2002 | Lee | 141/198 |
| 6,564,974 | B1 | 5/2003 | Manzke | |
| 2002/0161653 | A1 | 10/2002 | Walker et al. | |

FOREIGN PATENT DOCUMENTS

| | | | |
|---|---|---|---|
| EP | 1 526 485 | A3 | 6/2005 |
| GB | 2 163 727 | A | 3/1986 |
| GB | 2 407 428 | A | 4/2005 |
| SU | 822113 | B | 4/1981 |
| WO | 83/04447 | A1 | 12/1983 |
| WO | 02/12112 | A2 | 2/2002 |

* cited by examiner

BEVERAGE VENDING MACHINE INSTALLATION

FIELD OF THE INVENTION

The present invention relates to a beverage vending machine installation of the type commonly used, for example, for dispensing coffee and tea beverages.

BACKGROUND OF THE INVENTION

Vending machines for dispensing beverages such as coffee are well-known in the art. Typically, such vending machines allow for delivery of beverages in a 'self-service' mode of operation where a customer operates the vending machine without direct external supervision. Vending machines of this type may be provided as a stand-alone item situated on a worktop, bench or similar. Alternatively, where the vending machine is to be used in a public place as opposed to a private setting, it is known to locate the vending machine within a cabinet to form a vending machine installation. Typical locations for such vending machine installations include service stations and the communal areas of public buildings such as theatres, gymnasiums, cinemas, etc. The cabinet in which the vending machine is installed serves to provide a secure means of housing the vending machine to prevent unauthorised operation or access to parts of the vending machine not required for direct operation. In addition, the cabinet may provide sites for advertising and instructions for operation of the machine to be displayed. In known vending machine installations, access to the vending machine within the cabinet is provided by a rear-facing opening in the cabinet, that is, on the side of the cabinet opposed to the side at which the customer operates the vending machine. Opening the cabinet from the rear has in the past been necessary to allow access to the vending machine for repair and maintenance since a number of the components of the vending machine are inaccessible from the front side. It is preferable to situate the cabinet against a wall or similar structure to minimise the space taken up by the installation within the room, foyer, etc. A problem with known vending machine installations is that locating the installation in this way makes ready access to the rear of the cabinet difficult. Typically, this is solved by providing a room, corridor or similar space behind the wall against which the vending machine installation is located. Access is then obtained through an aperture in the wall. A disadvantage of this solution is that extra floor space is taken up by the room or corridor behind the cabinet.

It is well-known to try and make the dimensions of the vending machine installation as small as possible to allow the installation to be located in smaller establishments. However, this has a disadvantage that the vending machine and its associated equipment within the cabinet can be difficult to access for maintenance purposes, even where the cabinet is accessed from the rear. In particular, portions of the vending machine and ancillary equipment located on the lateral sides of the units are difficult to access due to the close proximity of other equipment and walls within the cabinet.

SUMMARY OF THE INVENTION

According to the present invention, there is provided a beverage vending machine installation comprising a cabinet and a trolley unit, the cabinet defining a void in which, in use, the trolley unit can be positioned, the cabinet further comprising an opening and at least one door moveable between open and closed positions, the trolley unit comprising a beverage vending machine, the trolley unit being moveable relative to the cabinet between an installed position, in which the trolley unit is positioned within the void of the cabinet such that the at least one door may be closed to allow operation of the beverage vending machine installation, and an uninstalled position, in which the trolley unit is removed from the cabinet after opening the at least one door to allow access to the trolley unit.

Advantageously, the beverage vending machine installation of the present invention may be installed in a wide variety of locations since no access is required to the rear of the cabinet either in use or during maintenance procedures. As a result, the vending machine installation may be installed hard up against a solid wall and there is no requirement to provide a room or other void space directly behind the cabinet. Thus, floor space is saved. Further, providing the vending machine on a trolley unit which may be uninstalled from the cabinet advantageously allows for much easier access to the components of the vending machine to carry out maintenance procedures. In addition, locating the vending machine on a trolley unit allows different vending machine assemblies to be quickly and easily swapped in and out of a single cabinet. For example, a defective vending machine may be easily removed and replaced with a working vending machine allowing the vending machine installation to be used by customers whilst the defective machine is repaired away from the installation.

Preferably, the opening of the cabinet is at a front face of the cabinet. The door of the cabinet may comprise upper and lower portions. The upper and lower door portions may be portions of a single door. The upper and lower doors may be opened independently of one another or may be moved as a single door. Parts and components requiring regular maintenance may be positioned behind the lower door such that the upper door need be opened less frequently. With the upper and lower doors closed, an aperture may be defined through which a user can operate the vending machine.

Preferably, the trolley unit comprises castors to allow the trolley unit to be rolled between the installed and uninstalled positions.

Preferably, the trolley unit comprises a load-bearing framework. The framework preferably comprises one or more guide bars and the cabinet comprises a guide frame, wherein on movement of the trolley unit from the uninstalled position into the installed position the guide bars and guide frame interact to locate the trolley unit relative to the cabinet. The interaction between the guide frame and the trolley framework ensures that the trolley unit is accurately and positively located when installed within the cabinet. It also makes the installation process simpler by allowing the installer to simply push the trolley unit inwards; the lateral location of the trolley unit is controlled by the guide frame.

Preferably, the trolley unit comprises a handle rotatably moveable from a vertical, stowed position and an in-use position.

Preferably, the cabinet comprises one or more ports for the conveyance of utilities and the trolley comprises one or more sockets for the reception of utilities wherein the ports and sockets are connectable in use by means of one or more conduits. The utilities may comprise one or more utilities selected from the group of electricity, telephone and mains water. A particular advantage of the present installation is that the trolley unit and cabinet and only a small number of connections therebetween. In one embodiment the cabinet and trolley unit are connected only by a mains water conduit and a mains electricity cable. Both connections may be provided with bayonet fittings, plugs or similar to allow the connections to be quickly and easily made and broken. This allows the trolley unit to be very quickly installed and removed from the cabinet.

The beverage preparation machine prepares and dispenses one or more beverages typically selected from the group of roast and ground coffee, tea, soup, chocolate, carbonated beverages or water. Other beverages may be dispensed as required.

The vending machine may be provided with storage containers, such as hoppers, for storing beverage preparation ingredients, which containers are arranged to supply the beverage preparation machine with a supply of beverage ingredient. Further, the cabinet may be provided with larger beverage storage containers so as to provide more beverages before refilling is needed. The beverage storage containers are, preferably, provided with apparatus for determining when the container is nearly empty and/or entirely empty.

The trolley unit may comprise an upper platform for supporting the beverage vending machine. Preferably, the trolley unit comprises a lower platform.

Preferably, the trolley unit comprises a refrigerator unit. Preferably, the refrigerator unit is positioned on the lower platform. Preferably, the refrigerator unit is accessible by opening the at least one door of the cabinet.

The trolley unit may comprise one or more cup holders.

The trolley unit may comprise one or more waste receptacles.

Preferably, the trolley unit comprises one or more mounting assemblies for ancillary equipment. Preferably, the one or more mounting assemblies are pivotable about a vertical axis. Preferably, the one or more mounting assemblies are pivotable from a first position, in which the mounting assemblies lie in close proximity with the at least one beverage preparation machine, and a second position, in which the mounting assemblies are rotated away from the at least one beverage preparation machine to allow access to all sides of the at least one beverage preparation machine and the ancillary equipment. Preferably, the at least one mounting assemblies comprise a horizontal platform mounted for rotation about a vertical support post, the vertical support post being mounted to the upper platform of the trolley unit. In addition, the horizontal platform may be slidable along an axis perpendicular to the vertical support post from a retracted position, in which the horizontal platform lies in proximity to the vertical support post, and an extended position, in which the horizontal platform is extended away from the vertical support post.

The ancillary equipment may comprise one or more items of equipment selected from the group comprising a beverage preparation machine, a refrigerator, a payment unit, a filtration unit—which is provided to filter water and ensure ongoing serviceability of the vending machine, a power supply unit or a waste receptacle unit.

Preferably, the cabinet comprises one or more ancillary doors moveable between a closed position, in which the ancillary equipment is shielded from access by a user of the vending installation, and an open position, in which the ancillary equipment may be accessed.

The beverage vending machine installation may, in a particularly preferred embodiment, comprise the at least one beverage preparation machine and a secondary beverage preparation machine mounted as an item of ancillary equipment.

The present invention also provides a beverage vending machine installation comprising a primary beverage preparation machine, a secondary beverage preparation machine, a customer interface, a telemetry device, and a system controller, wherein the system controller monitors and controls operation of the primary and secondary beverage preparation machines, the customer interface and the telemetry device, wherein the system controller further collates operational information from the primary and secondary beverage preparation machines and transmits said data to a secure site using the telemetry device. Advantageously, the single system controller collates and transmits data to the secure site for multiple elements of the installation. This allows equipment to be easily added or removed or interchanged within the installation without requiring additional telemetry devices to be fitted.

The system controller may comprise an interlock mechanism for preventing simultaneous operation of the primary and secondary beverage preparation machines.

The system controller may be operable to control the type, quantity and sequence of beverage ingredients delivered by the primary and secondary beverage preparation machines.

The primary and secondary beverage preparation machines may dispense at a single dispense point.

Preferably, the system controller is operable to monitor the status of the primary and secondary beverage preparation machines and in particular, quantities of beverage ingredients contained in said primary and secondary beverage preparation machines, and further is operable to exclude dispensation of beverage types where suitable beverage ingredients are not available.

In a preferred embodiment the system controller is operable to manage cleaning of the primary and secondary beverage vending machines. The system controller may be operable to notify an operator that cleaning of one or more beverage preparation machine is required. The system controller may be operable to shut down operation of the installation where cleaning is not undertaken within a predetermined time span or cleaning is initiated without inputting an authorization code into the customer interface.

Preferably, the system controller is operable to display cleaning instructions to the operator using the customer interface.

BRIEF DESCRIPTION OF THE DRAWINGS

An embodiment of the present invention will now be described, by way of example only, with reference to the accompanying drawings in which:—

DETAILED DESCRIPTION

Figure 6:
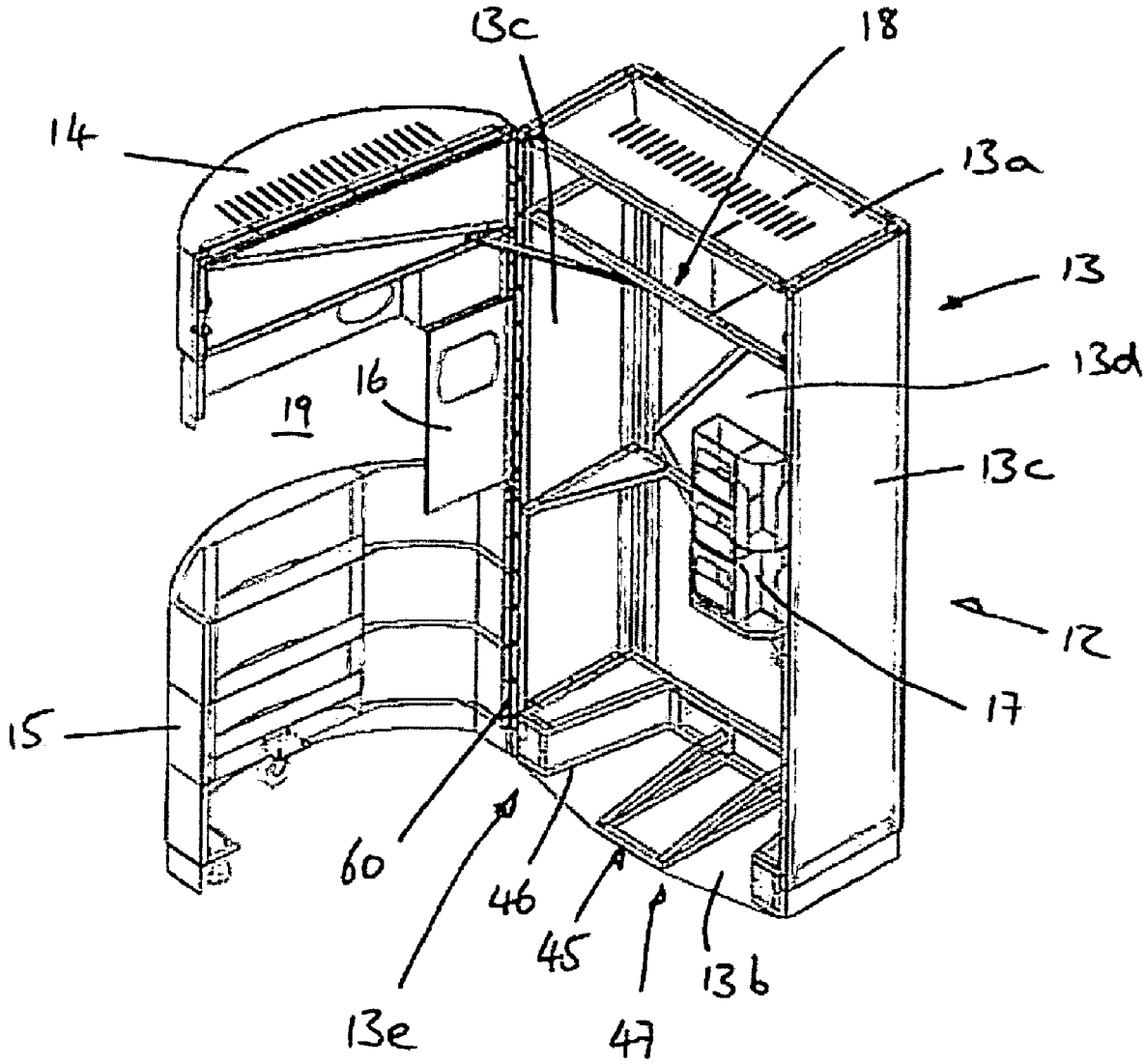
FIG. 6 is a perspective view of a cabinet of the vending machine installation of the present invention with a door of the cabinet in an open position.
Figure 7:
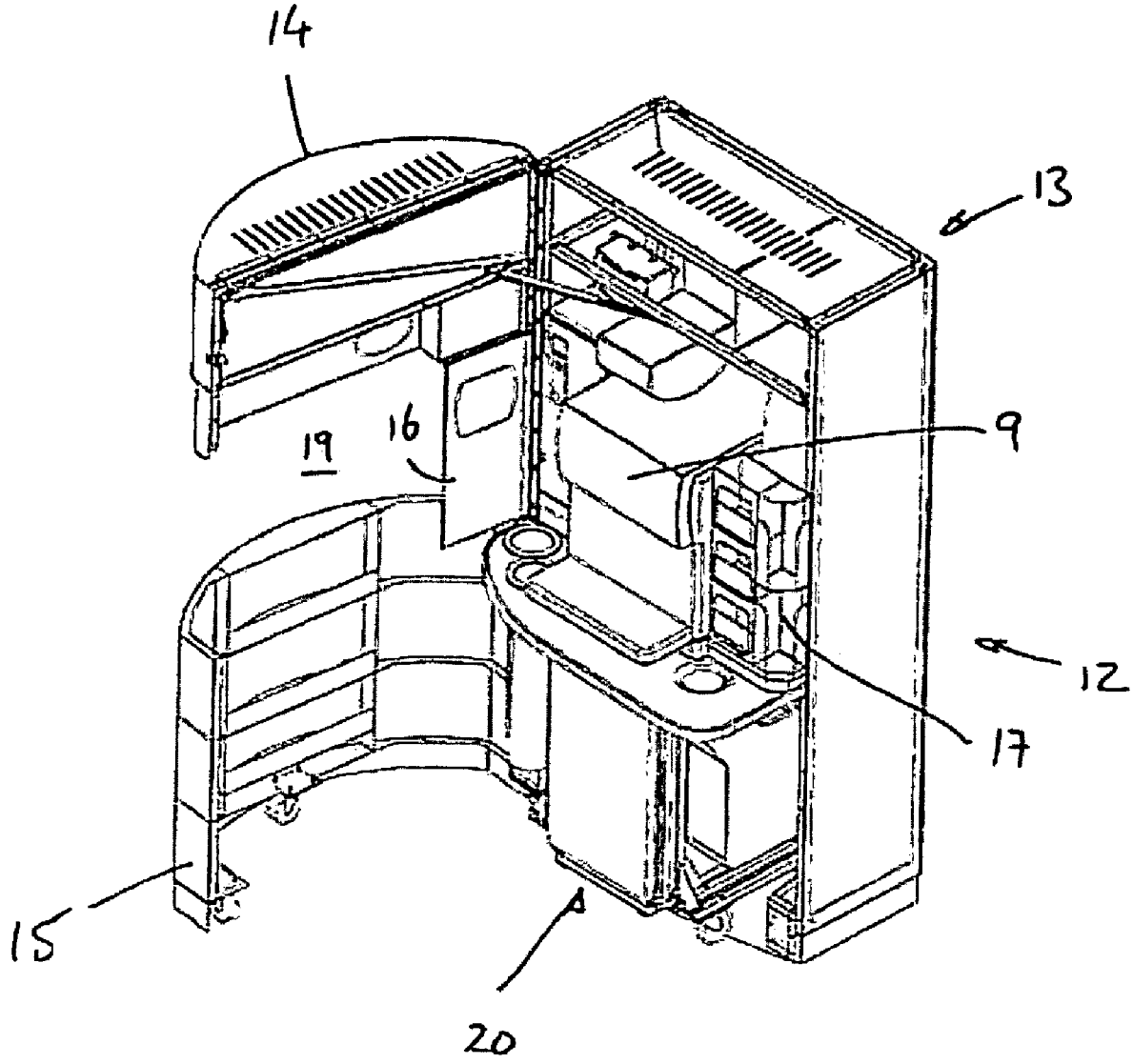
FIG. 7 is a perspective view of the trolley unit of FIG. 4 and the cabinet of FIG. 6 in combination.
Figure 8:
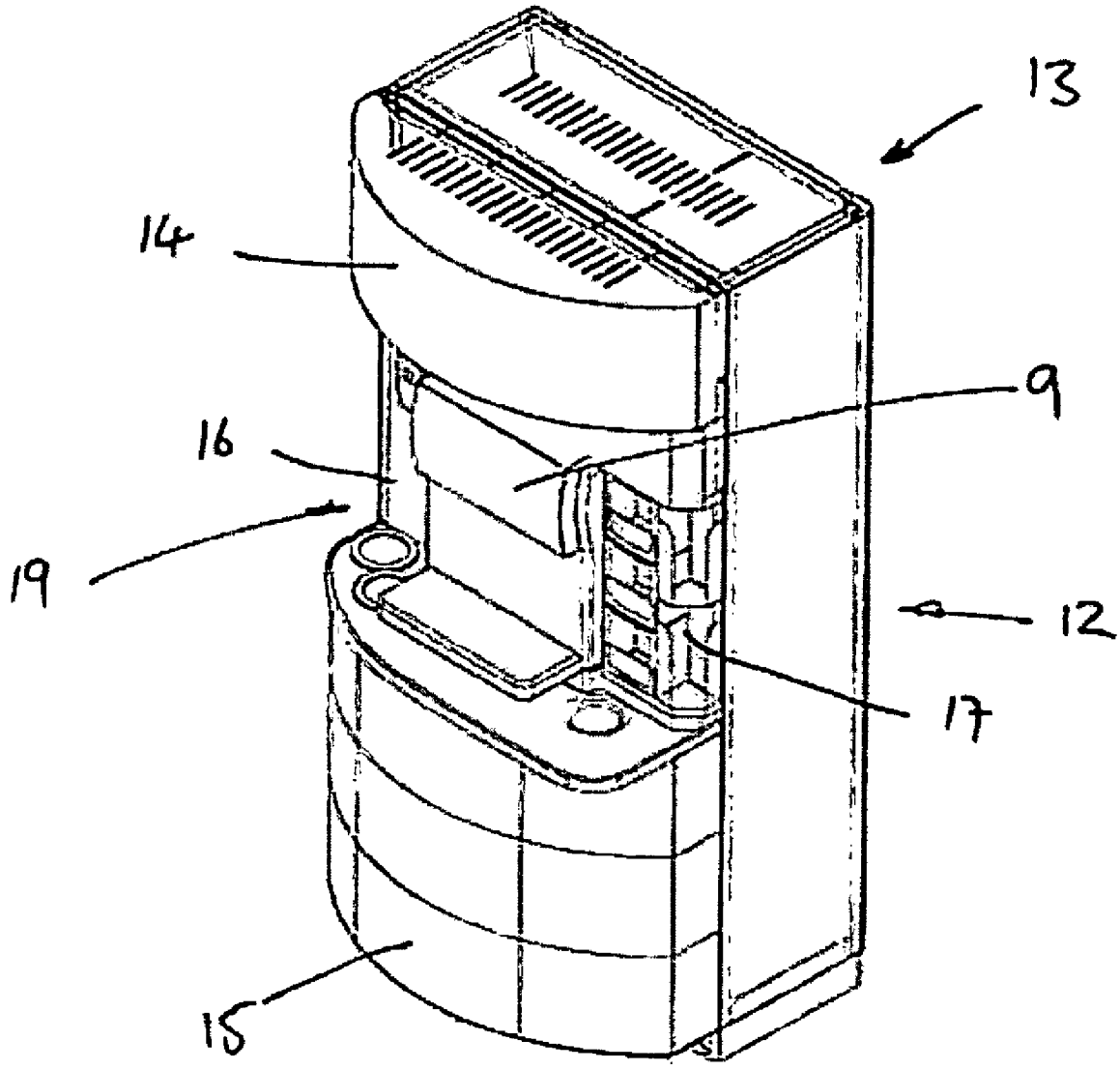
FIG. 8 of the vending machine installation ready for operation.

As shown in FIGS. 7 and 8, the beverage vending machine installation of the present invention generally comprises a trolley unit 1 which is removably installed in a cabinet 12. Referring to FIG. 6, the cabinet 12 comprises a housing 13 with a generally parallelepiped shape having an upper wall 13*a*, a lower wall 13*b*, two side walls 13*c*, a rear panel 13*d* and two doors 14, 15. The housing 13 is provided with an internal structural framework 18 of metal bars providing structural integrity and cross-bracing to the housing 13. A front face 13*e* of the housing 13 is open and, in use, is closed by the two doors 14, 15. The two doors 14, 15 form an upper door 14 and a lower door 15. The upper door 14 and lower door 15 are connected by a hinge 60 to the housing 13 and can be moved independently of one another between open and closed positions. Alternatively, the doors 14, 15 may be joined to move effectively as a single door. One or more locks may be provided on both the upper and lower doors 14, 15 to secure the doors in the closed position. As shown in FIG. 8, the upper door 14 and lower door 15 when in the closed position do not obscure the entire area of front face 13*e*. Instead, with the upper door 14 and lower door 15 in the closed positions, an aperture 19 is defined to allow a customer access to a vending machine installed within the cabinet 12 as will be described below. Advantageously, the cabinet 12 provides secure containment of the trolley unit 1 and may be secured to the floor or a near-standing wall for added security by means of bolts, for example.

Left and right ancillary unit doors 16, 17 are provided hinged to the cabinet 12, the use of which will be described below. The ancillary unit doors may be separate from the upper and lower doors 14, 15 or may be fixed thereto so as to move together with the upper and/or lower doors 14, 15. In the illustrated embodiment, the left ancillary door 16 is affixed to the upper door 14 whilst the right ancillary door 17 is separate from the upper and lower doors 14, 15.

A base region of the framework 18 of the cabinet 12 is provided with a guide frame 45 which comprises a plurality of metal members formed to provide a stable base for the cabinet 12. In addition, the guide frame 45 comprises a pair of angled guide bars 46 at either side of the cabinet 12. The four guide bars 46 define a mouth 47 of the guide frame 45 which is directed towards the open front face 13*e* of the housing 13. The pairs of guide bars 46 are angled towards one another as one moves towards the rear panel 13*d* of the housing 13 such that the clearance between the pairs of guide bars 46 narrows as one moves into the cabinet 12 from the front face 13*e*. The use of the guide bars 46 will be described below.

The structural frame 18 of the cabinet 12 may be made from a suitable material such as steel. Preferably, the members are welded together for maximum structural strength. However, other fixing means such as bolts or other releasable fasteners may be used.

The upper wall 13*a*, lower wall 13*b*, side walls 13*c*, rear panel 13*d* and doors 14, 15, 16 and 17 may be formed from suitable material such as sheet metal or plastics materials. The walls may be mounted to the framework 18 by known means such as rivets or releasable fasteners, e.g. bolts, clips, etc. Light fittings, advertising place holders, etc., may be mounted on the cabinet 12 in a known manner. The cabinet 12 is provided with one or more apertures (not shown) through which mains water pipes and electricity cables can be passed to allow the vending machine located within the cabinet 12 to be plumbed into the water and electricity supplies.

Figure 1:
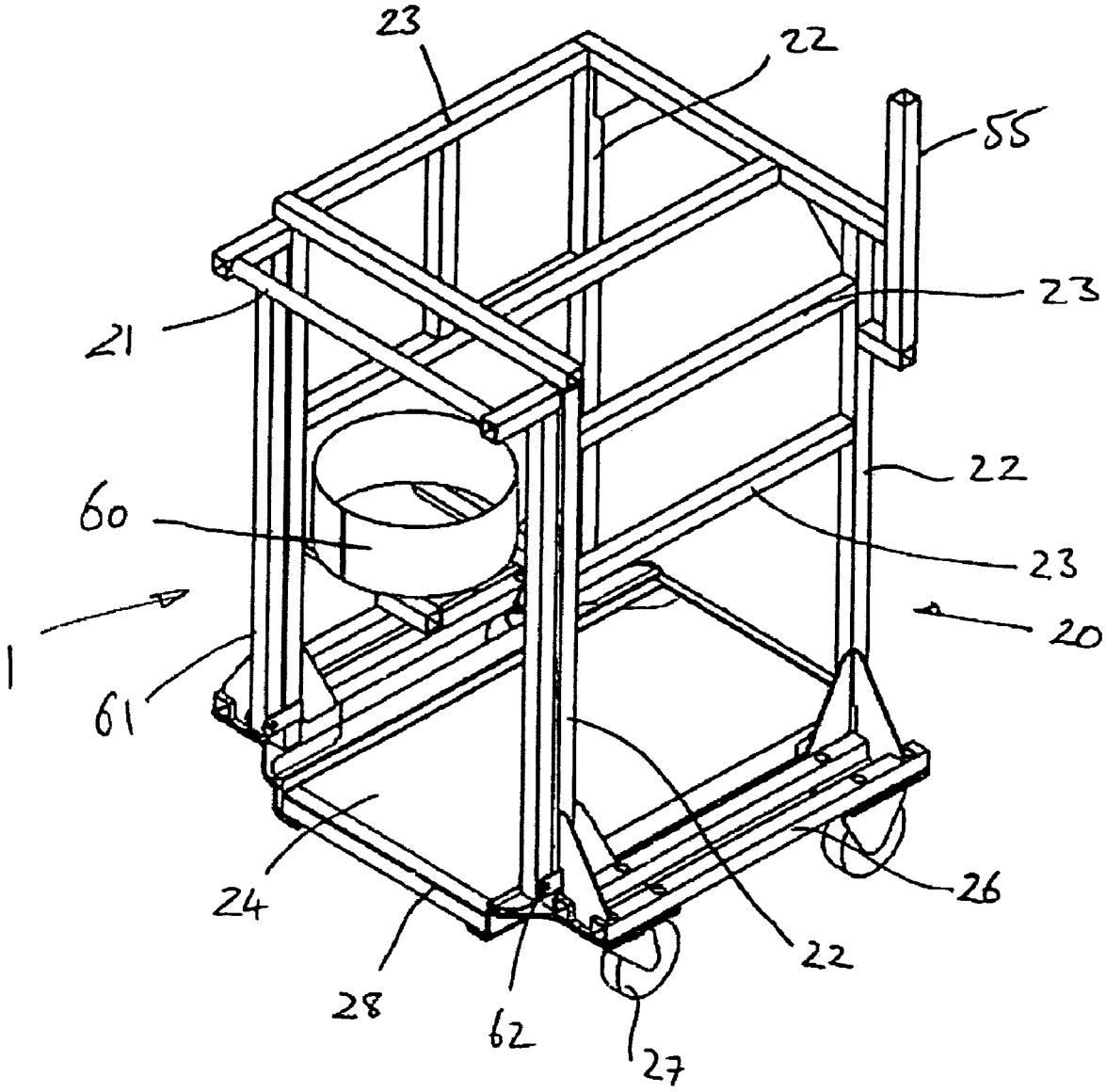
FIG. 1 is a perspective view of a trolley frame of a trolley unit of a beverage vending machine installation of the present invention.
Figure 2:
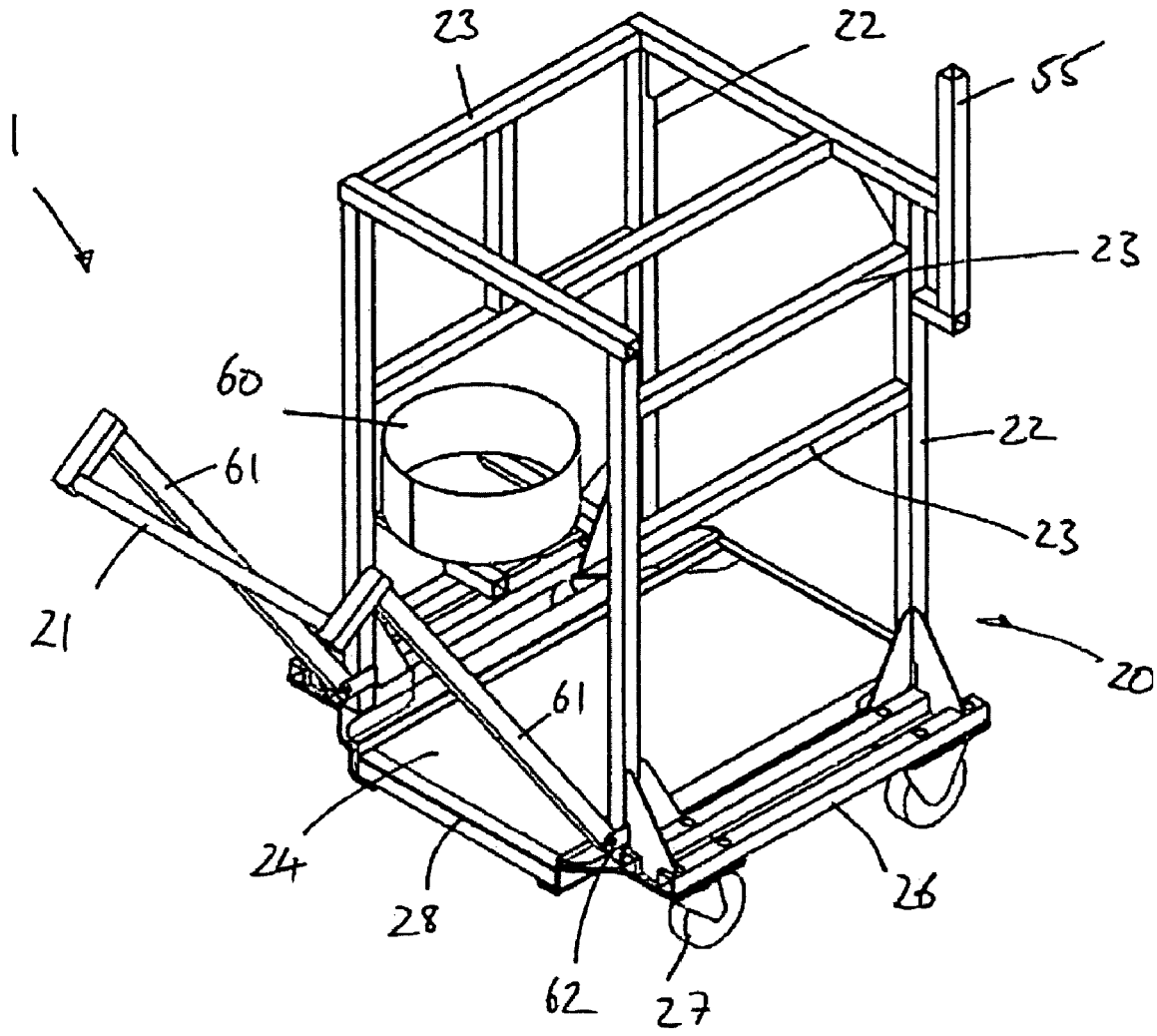
FIG. 2 is a perspective view of the trolley frame of FIG. 1 with a handle of the trolley frame in a lowered configuration.

As shown in FIG. 1, the trolley unit 1 comprises a trolley frame 20 on which is mounted the vending machine. The trolley frame 20 has a generally parallelepiped form comprising vertical upright members 22, crossbars 23 and a basal framework 25. A lower platform 24 is mounted on the basal framework 25, the use of which will be described below. A handle is provided for moving the trolley framework 20. The handle comprises a cross-bar 21 which is rotationally mounted to the trolley frame 20 by means of two struts 61 which are mounted to the trolley frame 20 at a lower end at hinge points 62. The handle can be rotated from a stowed position as shown in FIG. 1 in which the struts 61 are vertical to a in-use position, as shown in FIG. 2, in which the handle is rotated away from the trolley frame 20 to allow access to the cross-bar 21. The trolley frame 20 is moved by grasping the cross-bar 21. The trolley framework 20 is provided with four casters 27 to allow the trolley unit 1 to be easily moved by rolling on a hard surface such as a floor. The basal framework 25 comprises a rectangular arrangement of structural members and, in addition, a pair of guide extension members 26 located one on each side of the trolley framework 20. The use of the extension guide members 26 will be described below. Optionally, the trolley frame 20 may not have a handle but instead be maneuvered by grasping the frame 20 itself.

The trolley frame 20 also comprises a metal hoop 60 for retaining a water filter which may form part of the vending machine installation if required. The frame 20 also comprises a metal upright support post 55, the use of which will be described below.

Figure 3:
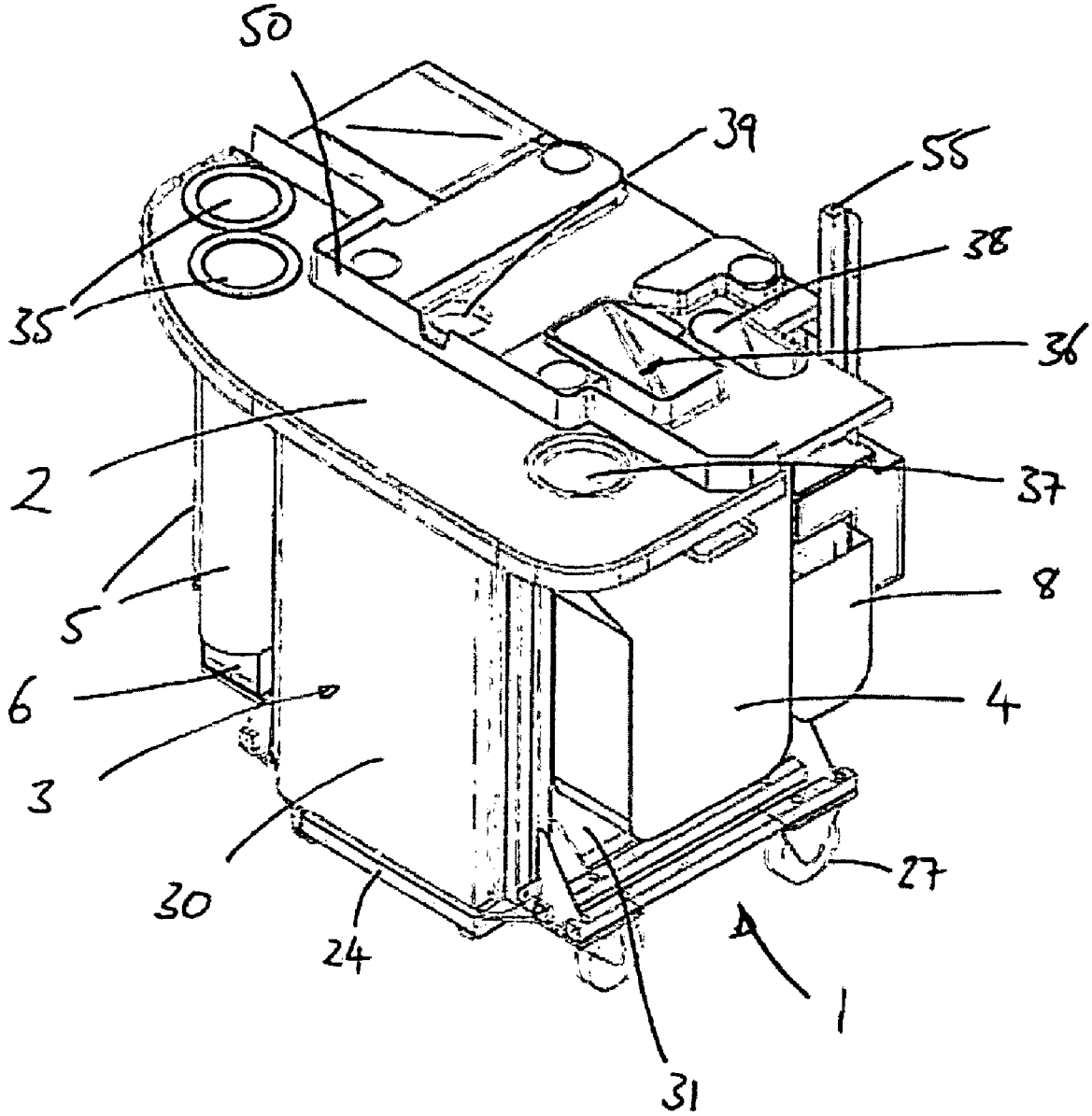
FIG. 3 is a perspective view of the trolley frame of FIG. 1 having mounted thereon an upper surface and a refrigerator.

As shown in FIG. 3, a refrigerator 3 is positioned in use within the trolley framework 20 resting on the lower platform 24. The refrigerator 3 comprises a housing 31 with a front-facing hinged door 30 which can be opened and shut whilst the refrigerator 3 is positioned within the trolley framework 20. The refrigerator 3 may be used to hold items requiring refrigeration. In particular milk for use in preparing beverages is stored in the refrigerator. Preferably, the milk is stored in pre-filled cartons. The capacity of the refrigerator is preferably large enough to hold at least two cartons of milk so that one carton can provide a back-up supply. Preferably, a piped connection is made from the carton of milk in the refrigerator upwards to the vending machine located on the trolley unit 1. The flow of milk along the piped connection may be driven by means of a pump or by means of a pressure drop produced by the vending machine at the remote end of the piped connection. Typically, a venturii flow in the vending machine may be used to produce the required pressure drop.

Also with reference to FIG. 3, the trolley unit 1 is provided with an upper platform 2 forming a support surface for the vending machine components. A number of apertures are provided within the upper platform 2, the use of which will now be described.

As most clearly shown in FIG. 3, the trolley unit 1 comprises two cup holders 5 which are accessed through two apertures 35 in the upper platform 2. The cup holders 5 are used to hold cups or similar containers ready for use by a customer. Further, the two cup holders may hold cups of different sizes.

A cash box 6 is mounted to the trolley unit 1 and accessed through a cash box aperture (not shown) in the upper platform 2 which is linked to a chute (not shown) which extends from the aperture to the cash box 6. The cash box 6 may further comprise a credit card slot and credit card reader to facilitate processing of credit card payments.

A waste bin 4 is mounted to the under surface of the upper platform 2. A first waste bin aperture 36 is provided in the upper platform 2 through which waste materials from the vending machine situated on top of the upper platform 2 may be dispensed into the waste bin 4. A secondary aperture 37 is provided for use by customers for manually disposing of unwanted items such as spent cups and napkins. The secondary aperture 37 also discharges into the waste bin 4.

A liquid waste bin 8 is also provided for liquid waste products from the vending machine. In addition, liquid waste may be expelled, via appropriate pipework to mains drainage. Other apertures may be provided in the upper platform 2 as required. For example, apertures 38 and 39 as shown in FIG. 3 are provided for allowing passage of cabling or pipework from below the upper platform 2 to the vending machine when mounted on the upper platform 2.

Figure 4:
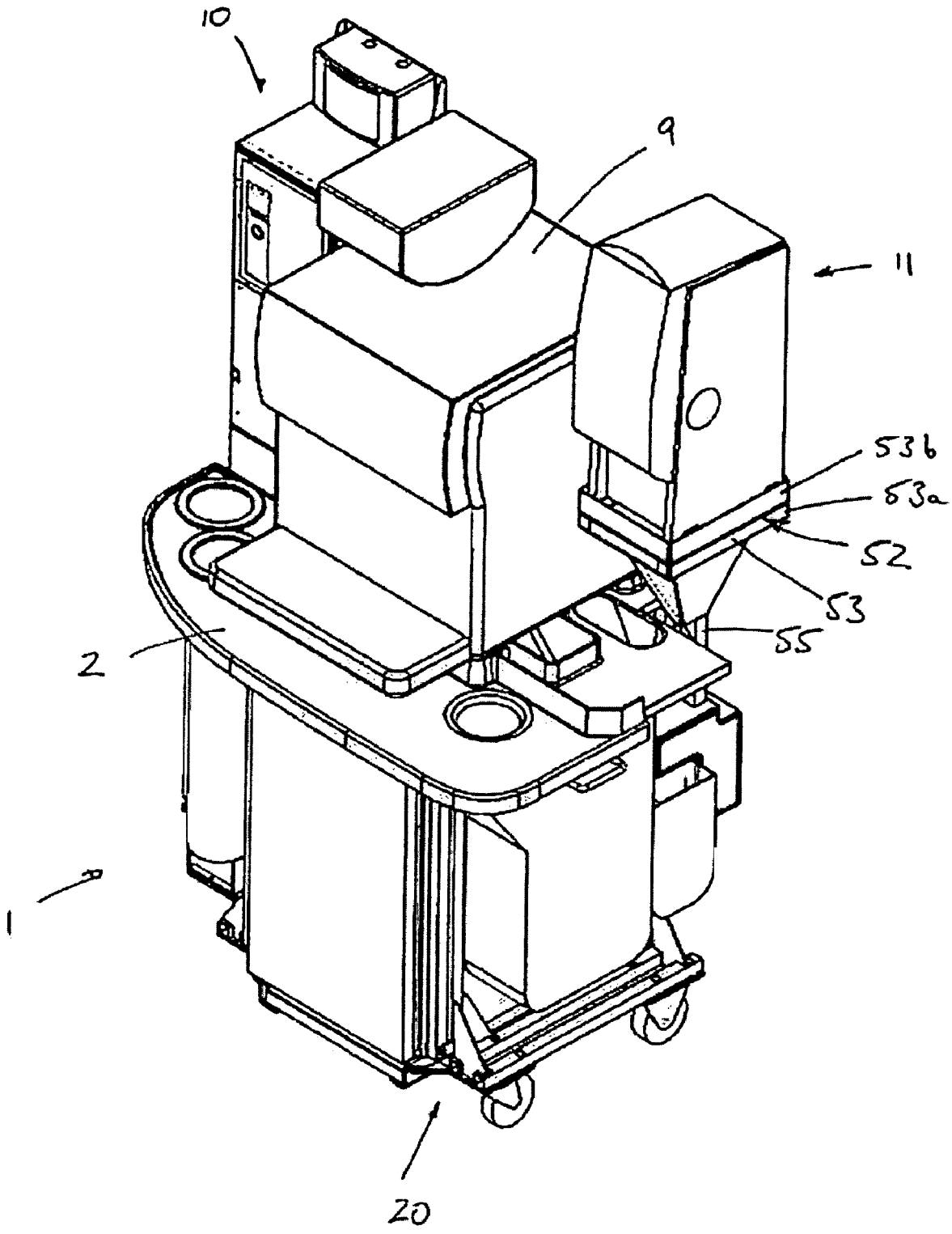
FIG. 4 is a perspective view of the trolley frame of FIG. 3 having a beverage preparation machine and ancillary units mounted thereon to form a trolley unit, the ancillary units being in a first position.

As shown in FIG. 4, the vending machine is mounted on the trolley frame 20. The vending machine comprises a number of component parts which cooperate together to dispense beverages and other items as directed by a customer. Central to the vending machine is a primary beverage preparation machine 9, which in this embodiment is shown in the form of a coffee brewer. The primary beverage preparation machine 9 is located centrally on the upper platform 2. The primary beverage preparation machine may be positively located against a C-shaped locating bracket 50 affixed to the upper surface of the upper platform 2 as shown in FIG. 3. The primary beverage preparation machine 9 may be of a known type and typically will comprise a source of roast and ground coffee—e.g. in the form of a hopper or similar, a water heater, a pump, connectors for connecting the primary beverage preparation machine 9 to electricity and mains water supplies, a steam generator and one or more dispensing outlets through which the prepared beverage is dispensed 30 into a receptacle. The primary beverage preparation machine 9 may be bolted to the upper platform 2 or may be retained simply by action of its own weight. The primary beverage preparation machine 9 may be designed to dispense only a single beverage or to dispense a range of beverages.

As shown in FIG. 4, one or more pieces of ancillary equipment are located to either side of the primary beverage preparation machine 9. In the illustrated embodiment two ancillary equipment units 10, 11 are mounted on pivotal stands 51. FIG. 4 shows the ancillary equipment units 10, 11 in a first position in which the ancillary equipment units 10, 11 face forwards and are parallel to the side walls of the beverage preparation machine 9 so that they lie in close proximity to the side wall of the primary beverage preparation machine 9. The stands 51 each comprise a horizontal platform 53 on which the ancillary equipment is mounted, either in fixed or free-standing manner. One of the platforms 53 is pivotally mounted to the support post 55 of the trolley frame 20 which extends upwardly from the upper platform 2. The other platform 53 is mounted directly to the upper platform 2. As such, the ancillary equipment may be rotated relative to the upper platform 2 by rotational movement of the platforms 53 about the support post 55 or upper platform 2. In addition, preferably, the platforms 53 comprise two components which are slidable relative to one another to allow the platforms 53 to be extended and retracted away from and towards the support posts 55 and/or upper platform 2 such that the ancillary equipment can be moved axially in a plane perpendicular to the support posts as well as rotationally.

Figure 5:
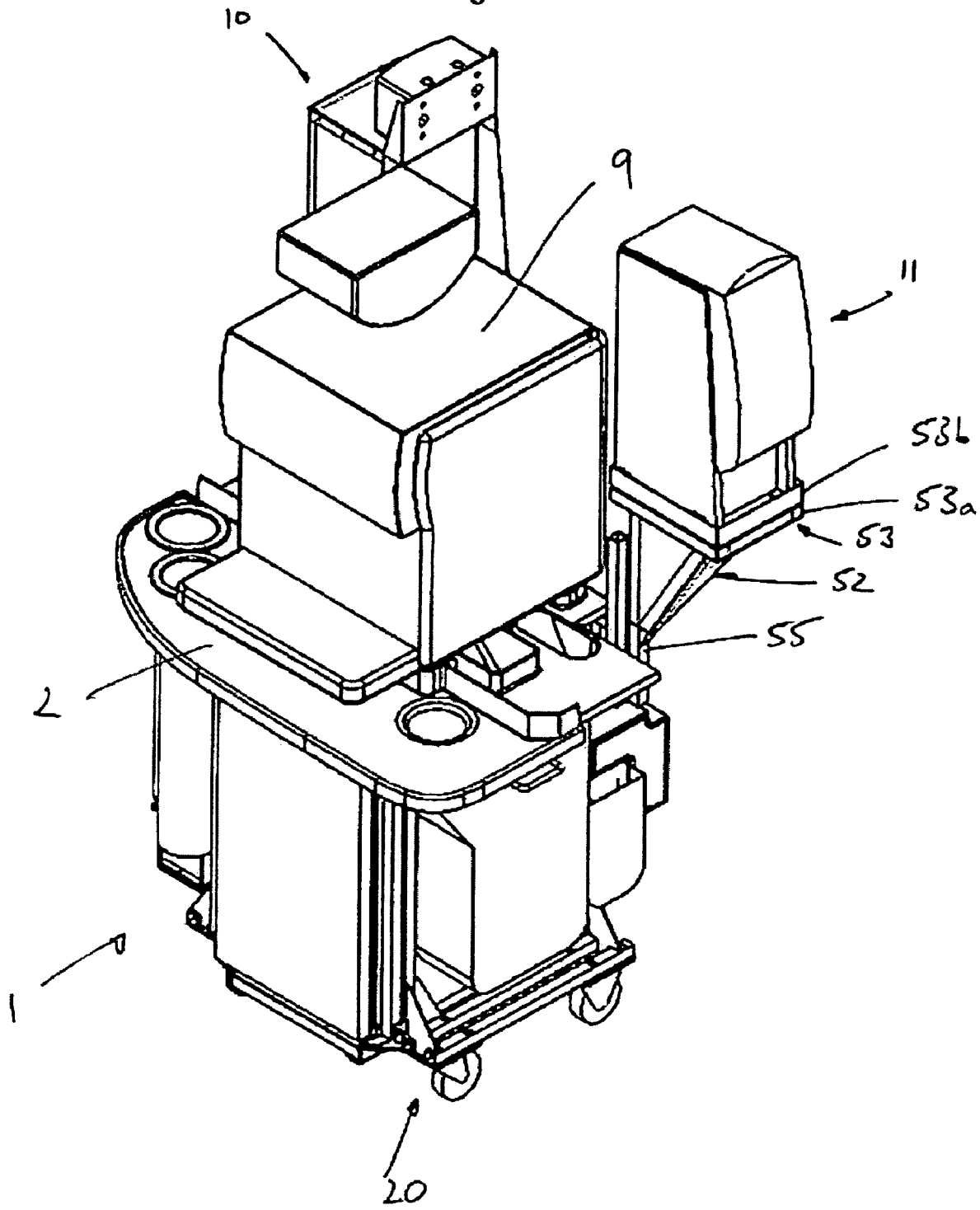
FIG. 5 is a perspective view of the trolley unit of FIG. 4 showing the ancillary units in a second position.

FIG. 5 shows the ancillary equipment units 10,11 in a second position in which the units 10,11 and stands 52 have been rotated away from the primary beverage preparation machine 9 to allow access to the lateral sides of both the ancillary equipment units 10, 11 and the primary beverage preparation machine 9. Extension and retraction of the platforms 53 also allows the ancillary equipment to be moved away from the primary beverage preparation machine to allow for easier access for maintenance.

The ancillary equipment units 10, 11 may be any of a range of components useful in carrying out vending operations. For example, the units may comprise a refrigerator, a steam generator, a payment unit, a filtration unit, a merchandise display unit or a waste receptacle. Advantageously, the ancillary units 10, 11 can be easily replaced and reconfigured without altering the location or settings of the primary beverage preparation machine 9. For example, one of the ancillary units 10 may be used for a payment unit taking cash payments, or credit card payments, for vending of beverages. This unit can then be swapped for a free-pay unit where the vending installation is to be used for free dispensation of beverages, when required.

In accordance with an aspect of the present invention, the ancillary units 10, 11 may comprise a secondary beverage preparation unit. The secondary beverage preparation unit may be designed to fulfil one or more dispense functions to complement the primary beverage preparation machine. For example, the secondary beverage preparation machine may be configured to perform the function of dispensing milk, whether cold, heated, steamed or frothed, as required to complement beverages brewed by the primary beverage preparation machine. The secondary beverage preparation unit may alternatively be configured to separately dispense a different beverage or range of beverages to that of the primary beverage preparation machine. For example, the primary beverage preparation machine 9 may be configured to dispense roast and ground coffee and tea with or without milk and the secondary beverage preparation machine may be configured to dispense hot chocolate. Preferably, the outputs of the primary and secondary beverage preparation machines are fed to a single dispense point which is accessed by the customer. Advantageously this minimises the dispense area required to be accessible to the customer and particularly importantly prevents any mistake on the part of the customer as to where to position the receptacle for correct dispensation. The two outputs of the primary and secondary beverage preparation machines may be combined at the dispense point into a single outlet nozzle or may each be provided with separate nozzles which are close enough to one another to allow a single dispense location for either output.

Preferably, a single, common customer interface is provided for the primary and secondary beverage preparation machines. The control software and hardware of the primary and secondary beverage preparation machines are operatively linked to the common customer interface such that both machines may be operated from the single interface. Preferably, the primary and secondary beverage preparation machines and customer interface comprise an interconnected interlock mechanism to prevent simultaneous operation of the primary and secondary beverage preparation machines. Thus, once a customer operates the interface to instruct, say, the primary beverage preparation machine to dispense a beverage operation of the secondary beverage preparation machine is prevented until dispensation is completed even if the appropriate controls on the customer interface are operated.

Advantageously the customer interface is provided on the primary beverage preparation machine since this is located centrally on the trolley unit 1 and in a typical configuration will be responsible for dispensing the majority of beverages.

The customer interface may comprise buttons, switches or other devices for registering a customer instruction. Further the customer interface may comprise a screen for displaying options and/or information for a customer to view. The customer interface is operatively connected to a system controller device, such that data, for example relating to a selection of a beverage, inputted into the customer interface is passed to the system controller device.

The system controller device is provided to control the everyday operation of the vending machine installation. The system controller device ensures correct management and reporting of the entire system of the vending machine installation, including, management of all financial transactions made between the customer and the vending machine installation, management of the beverage selection process and initiation of product dispensing equipment to deliver the appropriate beverage, and monitoring available product levels within the beverage preparation machines. Further, the system controller device interacts with a secure remote server at a secure internet location and data is uploaded to, and downloaded from, the remote server by a telemetry means, for example, fixed land line or via mobile communication apparatus, e.g. GSM.

Advantageously, the system controller device, and not the individual beverage preparation machines or payment system collates and reports data. A benefit of this arrangement is that additional equipment or payment systems, however complex or simple, may be added to the installation without the need for them to accommodate a remote telemetry system of their own.

Management of financial transactions involves managing transactions which may be direct, in the form of cash—either coins or notes—or indirect, using prepaid cashless or credit card payment systems. Where coins or notes are used, the cash is securely stored within the unit. Change is given where appropriate. Credit card transactions are managed remotely through the secure remote server so that credit card details can be verified.

The system controller device manages the beverage selection process and initiates product dispensation after input of a beverage selection by a customer into the customer interface. The system controller device initiates the beverage dispensing equipment to deliver the required beverage ingredients, in the correct amount and the correct sequence, to deliver the selected beverage. This may also include the addition of additional flavourings or toppings. The system controller also prevents conflicting operations being carried out by the primary and secondary beverage preparation machines. For example while the primary beverage preparation machine is dispensing, the system controller locks out operation of the secondary beverage preparation machine irrespective of any commands inputted by the user on the customer interface.

Monitoring product levels is carried out to determine the availability of certain beverages. Advantageously, the system controller device offers for sale only beverages which the vending machine is capable of dispensing. In other words, a customer is informed that the vending machine cannot dispense a particular beverage. If the system controller device ascertains that a particular beverage ingredient has run out or, indeed, is about to run out, it communicates such data to the secure remote server. Such communication of data prompts the remote server to contact a local operator, for example by pager or mobile telephone for example, to refill the vending machine installation appropriately.

The system controller device also monitors key elements within the beverage equipment, such as pumps, card readers, grinders etc. Any failure of these key elements will cause the system controller to exclude beverages which require the use of this particular equipment from the selection process and will report, via the remote server as mentioned above, any such failure. Such a report will initiate a service call out.

In addition, the system controller device records and reports all business transactions at predetermined intervals. This includes reporting of all financial transactions howsoever made, all beverage selections delivered by product type, and all monitored time-out conditions. Time-out conditions include but are not limited to:

- upper or lower doors not closed securely—prevents all beverage from dispensation;
- beverage dispensing equipment failure—prevents delivery of some beverages;
- product not available owing to the vending machine needing refilling—prevents delivery of beverages requiring the missing ingredients but allows other beverages to be dispensed;
- wet-waste bucket full or not present—prevents all beverage from dispensation;
- dry-waste container not present—prevents all beverage from dispensation;
- cashbox full or not present—prevents all beverage from dispensation;
- cups not available—prevents delivery of beverages in that size cup;
- power outage—prevents all beverage from dispensation; and
- water leak inside unit—prevents all beverage from dispensation.

These reports can be used directly or downloaded for local formatting using proprietary software applications for commercial modelling and reporting purposes.

Management of system cleaning processes is also carried out by the system controller device, so as to ensure product safety and equipment longevity. The system controller will, typically, require the primary and/or secondary beverage preparation machines to be cleaned at predetermined times, and, at least, once every day. At the predetermined time, the unit will notify the operator, via the secure remote server and/or local pager, that cleaning must be carried out. Failure to carry out cleaning will result in the vending machine being shut down until cleaning has taken place. In one embodiment, to initiate the cleaning process the operator will be required to enter cleaning mode at the system controller. The customer interface will provide instructions for the required cleaning operations. These instructions may include cleaning regimes for one or more ancillary equipment. Following the required cleaning by the operator, the operator is required to enter the PIN code into the customer interface in order to confirm that the required cleaning regimes have been thoroughly and properly carried out in accordance with the instructions given. The vending machine installation will then be re-activated for continued use until the next cleaning regime is required. Optionally, if the required cleaning activities have not been carried out, or an incorrect PIN number is used, the vending machine installation will remain out of service.

In a further embodiment, the system controller device may report the date and time of cleaning, together with the PIN number of the operator—which will identify that person. This information is uploaded at predetermined intervals to the secure remote server, as described above. Details of failed or fraudulent cleaning activities are also be reported in this way.

Sensor components can be fitted to monitor and provide data to the system control device for reporting, for example, the following:

- upper door open/closed;
- lower door open/closed;
- coffee product #1 sold out;
- coffee product #2 sold out;
- chocolate product sold out;

liquid-milk product sold out;
liquid-milk product over temperature;
large cups sold out;
regular cups sold out;
cash box missing;
cash box full;
dry-waste bin missing or full;
liquid-waste bin missing or full;
primary beverage preparation machine failure;
secondary beverage preparation machine failure;
primary beverage preparation machine cleaning; monitor; and
secondary beverage preparation machine cleaning monitor.

In a further embodiment, the system controller device may interact with the remote secure server via a total of two modes of interaction, for example two fixed land lines or two sets of mobile communication apparatus, or one of each. One mode of interaction can be dedicated specifically for verification and reporting of credit card transactions, and the other dedicated specifically for the reporting and management of the system alerts of the vending machine installation, as discussed above. Credit card transactions data can be forwarded directly to a financial clearing institution.

The ancillary unit doors 16, 17 may be designed to allow access to the ancillary units by the customer or may alternatively be used to mask the ancillary units 10, 11. Further, the ancillary unit doors 16, 17 may provide access to ancillary items, such as, cup lids, stirrers, napkins and the like and/or product branding opportunities, optionally, contained within the ancillary units 10, 11 or on a reverse side of the ancillary unit doors 16,17. In particular, where one of the ancillary units is a secondary beverage preparation machine the ancillary unit door may be used to prevent the customer directly accessing the secondary beverage preparation machine.

In a further embodiment, the primary and/or secondary beverage preparation machines may be capable of storing beverage ingredients such as whole coffee beans or chocolate drink mix. For example, a number of different roasts or blends may be stored including, perhaps, decaffeinated coffee. The choice of blend can be made by a customer selecting the desired drink, in the usual manner in the customer interface, as can the desired strength of coffee. In order to carry out this function, the primary and/or secondary beverage preparation machine may be provided with beverage storage containers for storing of beverage ingredients and measuring apparatus for measuring an appropriate quantity the beverage ingredient. The beverage storage containers are arranged to supply the primary and/or secondary beverage preparation machines with beverage ingredients. In addition, the primary and/or secondary beverage preparation machine may be provided with grinding apparatus to produce ground coffee from the coffee beans, with which to prepare the beverage. Advantageously, a user is be provided with a freshly-ground coffee beverage.

Although the primary and/or secondary beverage machines may be supplied with beverage ingredients from containers located on the trolley unit 1, larger containers may be located in the cabinet 12, which allow more beverages to be dispensed before refilling is required.

To install the vending machine installation the cabinet 12 is first placed in the desired location, which may be free-standing or located against a wall, or other solid structure and, optionally, secured thereto with bolts. The doors 14, 15, 16, 17 are then opened and the trolley unit 1, bearing the vending machine, is wheeled into the cabinet 12. As the trolley unit 1 enters the cabinet 12 the guide extension members 26 contact and slide against the guide bars 46 of the guide frame 45 located in the cabinet 12. The interaction of the guide extension members 26 and the guide bars 46 ensures that the trolley unit is correctly located with the void space of the cabinet 12. Connections between the trolley unit 1 and the cabinet 12 are made to convey mains electricity and mains water. With the trolley unit 1 in position the doors 14, 15, 16 and 17 are closed and, if required, locked. Preferably the configuration of the doors requires the ancillary unit doors 16, 17 to be closed before and opened after the upper door 14 and lower door 15. Thus, separate locking mechanisms on the ancillary doors 16, 17 are not required since access can not be obtained until the upper door 14 and lower door 15 are opened.

The vending machine is operated by a customer inputting instructions on the customer interface which is accessed through the aperture 19.

The vending machine installation may also be provided with containers and dispensing apparatus for containing and dispensing an additional beverage flavouring, such as vanilla or hazelnut, in either powder or liquid form.

Preferably, all beverage ingredient storage containers are provided with apparatus for determining when the container is nearly empty and/or entirely empty. Such data can be forwarded to the system controller device and uploaded to the secure remote server, in the manner mentioned above, so as to alert an operator to refill the vending machine, preferably, before the containers are entirely empty.

The invention claimed is:

1. A beverage vending machine installation comprising a cabinet and a trolley unit, the cabinet defining a void in which, in use, the trolley unit can be positioned, the cabinet further comprising an opening and at least one door moveable between open and closed positions, the trolley unit comprising at least one beverage preparation machine, the trolley unit being moveable relative to the cabinet between an installed position, in which the trolley unit is positioned within the void of the cabinet such that the at least one door may be closed to allow operation of the vending machine installation, and an uninstalled position, in which the trolley unit is removed from the cabinet after opening the at least one door to allow access to the trolley unit;

wherein the cabinet comprises one or more ports for the conveyance of utilities and the trolley comprises one or more sockets for the reception of utilities wherein the ports and sockets are connectable in use by means of one or more conduits;

wherein the utilities comprise one or more utilities selected from the group of electricity, telephone and mains water;

wherein the beverage preparation machine prepares and dispenses one or more beverages selected from the group of roast and ground coffee, tea, soup, chocolate, carbonated beverages or water;

wherein the trolley unit comprises an upper platform for supporting the preparation machine, a lower platform, a refrigerator unit positioned on the lower platform and accessible by opening the at least one door of the cabinet, one or more cup holders, one or more waste receptacles, and one or more mounting assemblies for ancillary equipment;

wherein the one or more mounting assemblies are pivotable about a vertical axis and the ancillary equipment comprises one or more items of equipment that are configured to be removed and replaced with a different ancillary equipment item;

wherein the one or more mounting assemblies are pivotable from a first position, in which the mounting assemblies lie in close proximity with the at least one beverage preparation machine, and a second position, in which the one or more mounting assemblies are rotated away from the at least one beverage preparation machine to allow access to all sides of the at least one beverage preparation machine and the ancillary equipment;

wherein the one or more mounting assemblies comprise a horizontal platform mounted for rotation about a vertical support post, the vertical support post being mounted to the upper platform of the trolley unit; and wherein the horizontal platform is slidable along an axis perpendicular to the vertical support post from a retracted position, in which the horizontal platform lies in proximity to the vertical support post, and an extended position, in which the horizontal platform is extended away from the vertical support post.

2. The beverage vending machine installation as claimed in claim 1 wherein the opening of the cabinet is at a front face of the cabinet.

3. The beverage vending machine installation as claimed in claim 1 wherein the door comprises upper and lower portions.

4. The beverage vending machine installation as claimed in claim 3 wherein the upper and lower door portions are portions of a single door.

5. The beverage vending machine installation as claimed in claim 1 wherein, with the at least one door closed, an aperture is defined through which a user can operate the beverage vending machine.

6. The beverage vending machine installation as claimed in claim 5 wherein the trolley unit comprises castors to allow the trolley unit to be rolled between the installed and uninstalled positions.

7. The beverage vending machine installation as claimed in claim 6 wherein the trolley unit comprises a load-bearing framework.

8. The beverage vending machine installation as claimed in claim 7 wherein the framework comprises one or more guide bars and the cabinet comprises a guide frame, wherein on movement of the trolley unit from the uninstalled position into the installed position the guide bars and guide frame interact to locate the trolley unit relative to the cabinet.

9. The beverage vending machine installation as claimed in claim 8 wherein the trolley unit comprises a handle rotatably moveable from a vertical, stowed position and an in-use position.

10. The beverage vending machine installation as claimed in claim 1 wherein the one or more items of ancillary equipment are selected from the group comprising a beverage preparation machine, a refrigerator, a payment unit, a filtration unit, a power supply unit or a waste receptacle unit.

11. The beverage vending machine installation as claimed in claim 10 comprising the at least one beverage preparation machine and a secondary beverage preparation machine mounted as an item of ancillary equipment.

12. The beverage vending machine installation as claimed in claim 10 wherein the cabinet comprises one or more ancillary doors moveable between a closed position, in which the ancillary equipment is shielded from access by a user of the vending installation, and an open position, in which the ancillary equipment may be accessed.

* * * * *